US007520584B2

(12) United States Patent
Horiuchi

(10) Patent No.: US 7,520,584 B2
(45) Date of Patent: Apr. 21, 2009

(54) RECORDING APPARATUS, AND FEED CONTROL METHOD OF RECORDING MEDIUM IN THE APPARATUS

(75) Inventor: Akinori Horiuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/143,978

(22) Filed: Jun. 23, 2008

(65) Prior Publication Data

US 2008/0260447 A1 Oct. 23, 2008

Related U.S. Application Data

(63) Continuation of application No. 10/932,809, filed on Sep. 2, 2004, now Pat. No. 7,393,075.

(30) Foreign Application Priority Data

Sep. 5, 2003 (JP) ..... 2003-314423

(51) Int. Cl.
*B41J 29/38* (2006.01)
*B41J 2/01* (2006.01)

(52) U.S. Cl. ..... 347/16; 347/101

(58) Field of Classification Search ..... 347/16, 347/101; 271/10.01–10.03, 10.06, 10.09
See application file for complete search history.

(56) References Cited

U.S. PATENT DOCUMENTS 4,442,769 A 4/1984 Kallin
5,738,457 A 4/1998 Ishida et al.
6,341,834 B1 1/2002 Yokoi
6,435,641 B1 8/2002 Tung et al.
6,460,969 B1 10/2002 Pinkernell
6,604,804 B2 * 8/2003 Asawaka ..... 347/14

FOREIGN PATENT DOCUMENTS

JP 2000-159392 6/2000
JP 2002-283637 10/2002

OTHER PUBLICATIONS

Japanese Office Action dated Jun. 20, 2008 on a corresponding counterpart Japanese Application No. 2004-254682.

* cited by examiner

*Primary Examiner*—Julian D Huffman
*Assistant Examiner*—Jason S Uhlenhake
(74) *Attorney, Agent, or Firm*—Locke Lord Bissell & Liddell LLP

(57) ABSTRACT

A recording apparatus records an image by relatively moving a recording head with respect to a recording sheet. When a recording sheet is conveyed by rotating a LF roller in accordance with recording operation at the recording position during the recording of a current recording sheet, it is determined whether or not recording for a next recording sheet is necessary. In the case of that recording for the next recording medium is necessary, the next recording sheet is fed by rotating the feed roller for the amount corresponding to the conveyance distance by rotation of the LF roller, in synchronization with the conveyance of the current recording sheet by rotation of the LF roller.

7 Claims, 10 Drawing Sheets

RECORDING APPARATUS, AND FEED CONTROL METHOD OF RECORDING MEDIUM IN THE APPARATUS

CROSS-REFERENCE TO RELATED APPLICATIONS

This application is a continuation of U.S. patent application Ser. No. 10/932,809 filed Sep. 2, 2004 now U.S. Pat. No. 7,393,075 which claims priority to Japanese Patent Application No. 2003-314423 filed on Sep. 5, 2003, the entire contents of all of which are hereby incorporated by reference as if fully set forth herein.

FIELD OF THE INVENTION

The present invention relates to a recording apparatus, such as an inkjet printer, a laser beam printer or the like, and a feed control method of recording medium in the apparatus.

BACKGROUND OF THE INVENTION

Recently, in a recording apparatus such as an inkjet printer which is connected to a computer, higher printing speed is required as the speed of computer systems increases. Furthermore, to meet the demands for a larger amount of printing paper (recording medium), increasing the number of printing paper is realized by incorporating a paper feed cassette that accommodates a large numbers of papers in the recording apparatus. However, the use of paper feed cassette elongates the paper conveyance distance, ultimately increasing the paper feed time. To increase the recording processing speed of an inkjet printer, reduction of paper feed time is desired.

In a conventional recording apparatus, image data received from a host computer is analyzed, a command is transmitted to a mechanical controller based on the analysis, and the operation of the recording apparatus starts. In this case, a paper is first picked up from the paper feed cassette, and then the paper feed operation starts. When it is confirmed that the paper is conveyed to a recording position by the paper feed operation, a printing command is transmitted to the mechanical controller to perform recording operation. Upon completion of recording one line or one band, a paper advance command is transmitted to the controller to advance the paper for the length corresponding to the recorded portion. By repeating the above operation, image recording of the entire page is performed. After the recording operation ends, a paper discharge command is executed to discharge the recorded paper. After the paper discharge operation completes, the feed operation of the next printing sheet starts.

Recently, as the capacity of the paper feed device including a paper feed cassette enlarges, the paper conveyance distance between the start point of the paper feed operation and the recording position is elongated. For this reason, in the conventional paper feed control, it is impossible to achieve an effect of improved throughput and is difficult to realize increased recording speed (Japanese Patent Application Laid-Open No. 2000-159392).

To save the time required for paper feeding and to increase recording speed, a recording apparatus which starts feeding of a paper for the next recording operation from the paper feed cassette during the current recording operation has been developed. In this recording apparatus, the paper pickup operation (pickup a paper from a paper cassette and feed it to a recording position) and paper feed operation (paper feed of a paper being recorded and for discharge the recorded paper) paper are performed by the rotation of one motor. In a case where there are a plurality of paper feed means and the means are removable as an option, the paper pickup operation and paper feed operation may not be performed by the one motor.

In a recording apparatus capable of loading a large amount of papers, e.g., a laser beam printer, paper pickup operation for the next recording is performed during recording operation of the current paper. However, paper pickup operation is independent of the paper feed operation, and the paper feed operation is performed as a series of operation. This is because, in a large apparatus such as a laser beam printer, it is possible to construct the apparatus such that the paper pickup operation and paper feed operation are performed independently of each other. However, in a small apparatus such as an inkjet recording apparatus, it is impossible from the aspect of cost to construct the apparatus to perform the paper pickup operation and the paper feed operation during recording operation.

SUMMARY OF THE INVENTION

The present invention has been proposed in view of the above-described problem. The characteristic of the present invention is to provide a recording apparatus, which can perform feed processing of a recording medium used in the next recording operation in parallel with conveyance of a recording medium used in the current recording operation, to achieve improved recording speed at low cost, and a feed control method of recording medium in the recording apparatus.

Furthermore, another aspect of the present invention provides a recording apparatus which can immediately convey a recording medium for the next recording to a recording position after the current recording operation is completed, and a feed control method of recording medium in the recording apparatus.

According to an aspect of the present invention, there is provided with a recording apparatus for recording by relatively moving a recording head with respect to a recording medium, the apparatus comprises: medium conveying means for conveying a recording medium at least at a recording position where recording is performed by the recording head; medium feeding means for picking up a recording medium from a housing unit housing a plurality of recording media and feeding the recording medium to a position conveyable by the medium conveying means; determining means for determining whether or not image recording for a next recording medium is necessary during recording of a current recording medium being recorded at the time; and control means for, in a case where it is determined by the determining means that the recording of the next recording medium is necessary, controlling the medium feeding means to feed the next recording medium for a distance corresponding to a conveyance distance of the current recording medium by the medium conveying means, in synchronization with the conveyance of the current recording medium by the medium conveying means.

According to an aspect of the present invention, there is provided with a recording medium feed control method of a recording apparatus for recording by relatively moving a recording head with respect to a recording medium, the method comprises: a medium conveying step of conveying a recording medium through in a conveyance path including a recording position by rotating a LF roller during recording; a medium feeding step of picking up a recording medium from a housing unit housing a plurality of recording media and conveying the recording medium in the conveyance path to a position conveyable by the LF roller; and a control step of, in a case where it is determined that recording for a next recording medium is necessary during recording of a current recording medium being recorded, controlling feeding of the next recording medium in the medium feeding step to feed for a distance in the conveyance path, corresponding to a conveyance distance of the current recording medium by the LF roller, in synchronization with the conveyance of the current recording medium by the LF roller in the medium conveying step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

Hereinafter, a preferred embodiment of the present invention is described in detail in accordance with the accompanying drawings.

Figure 1:
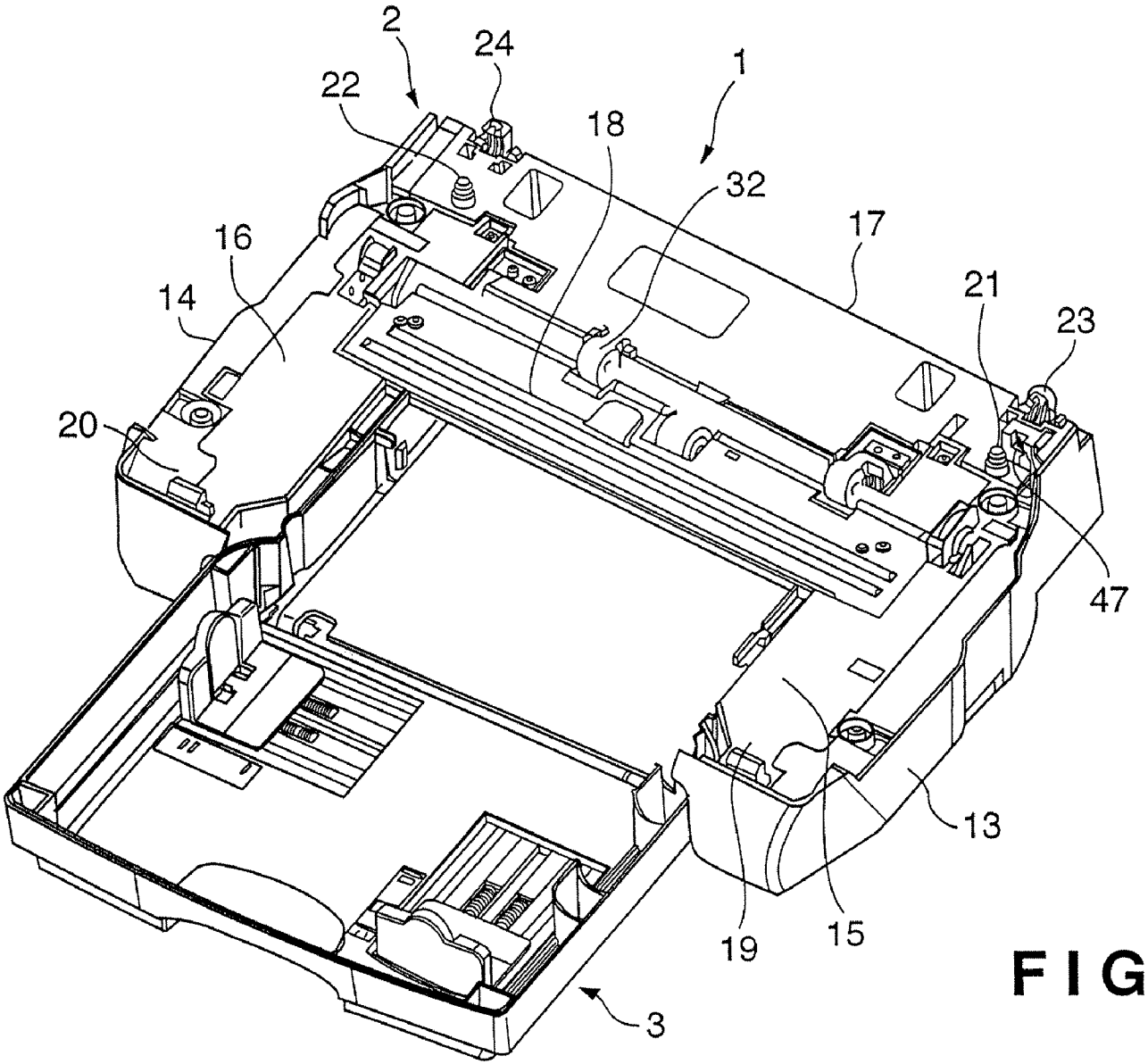
FIG. 1 depicts a perspective view showing an external appearance of a paper feed unit employed in an inkjet printer according to an embodiment of the present invention.
Figure 2:
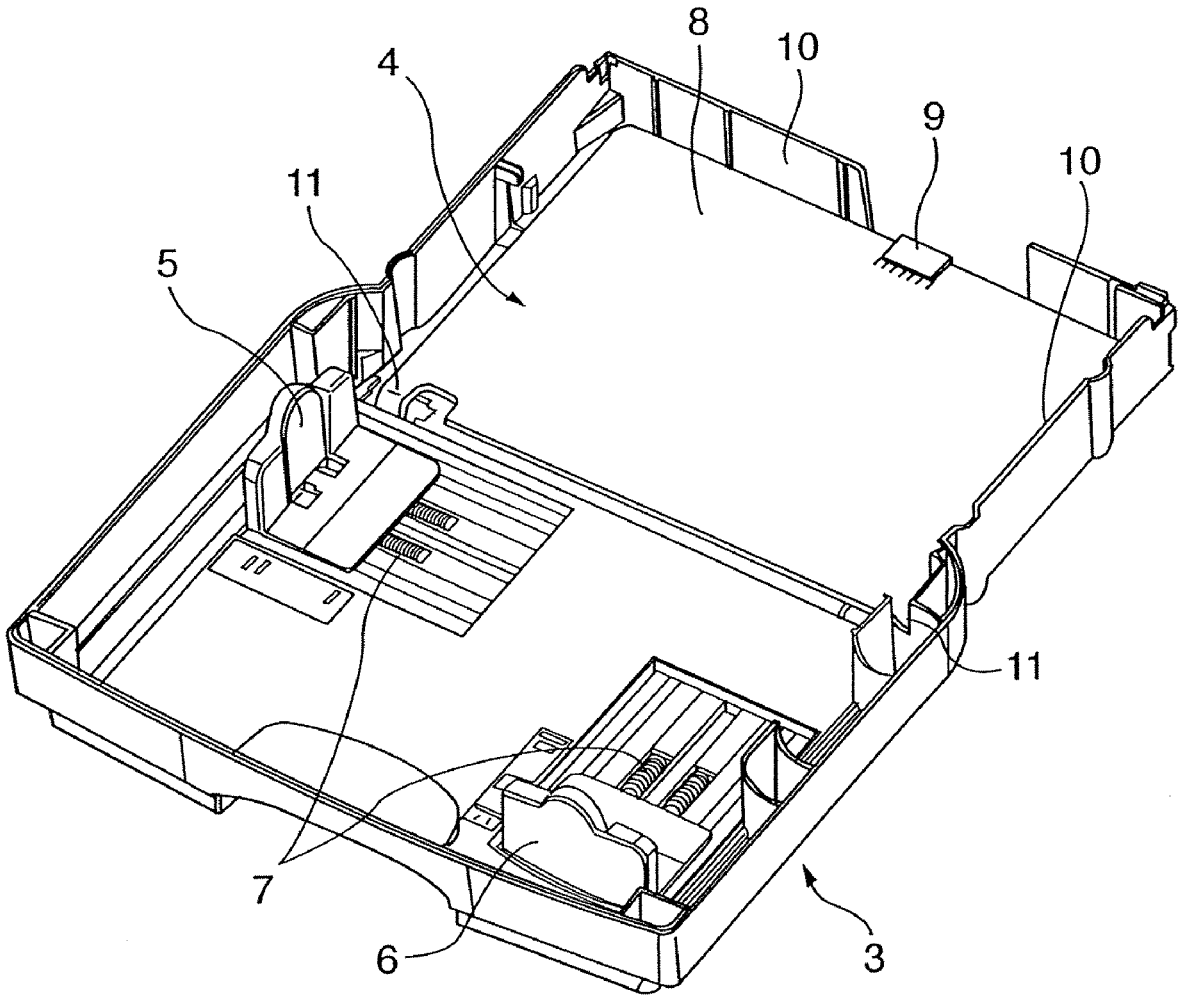
FIG. 2 depicts a perspective view showing a paper feed cassette of the paper feed unit according to the present embodiment.
Figure 3:
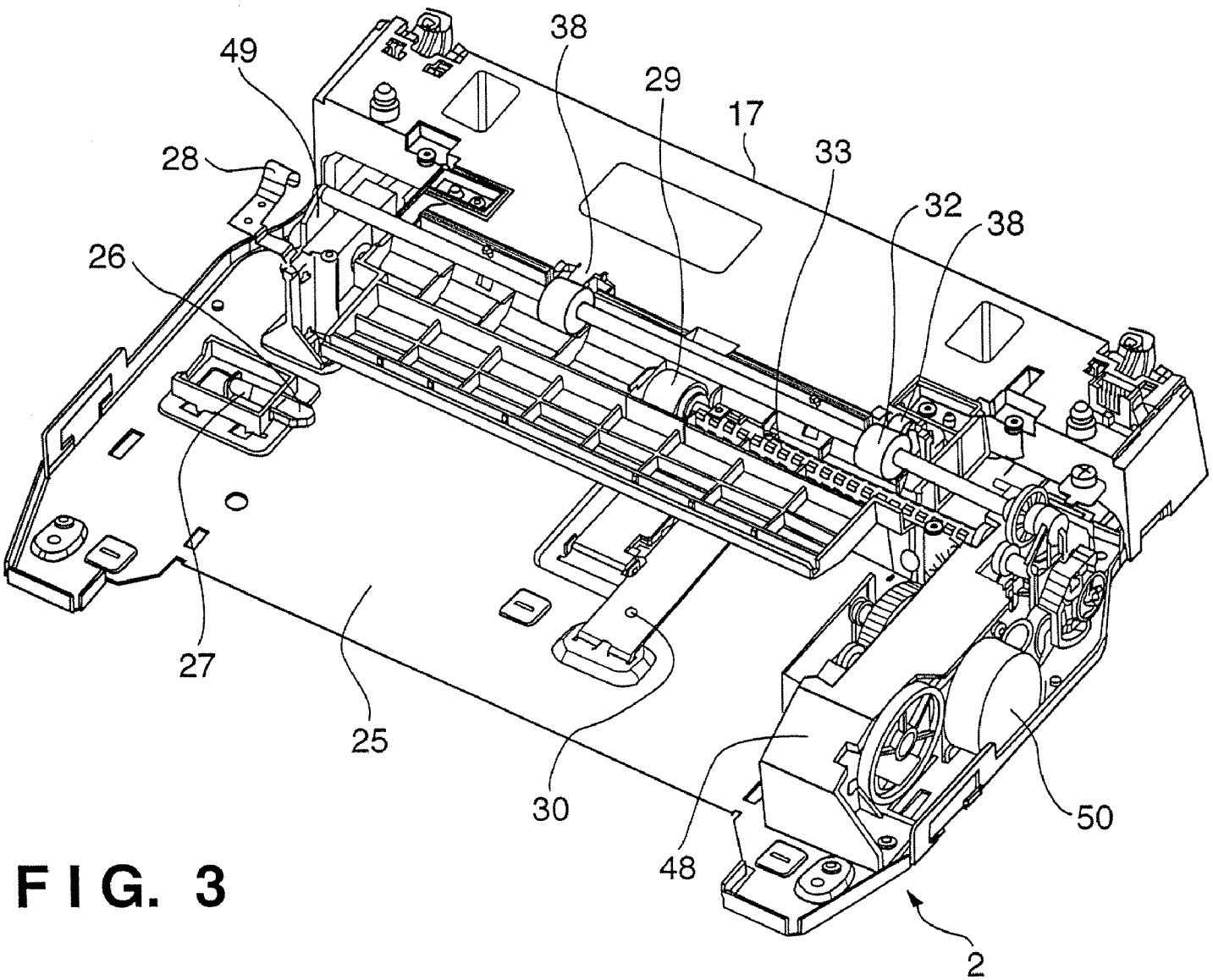
FIG. 3 depicts a perspective view showing an external appearance of the paper feed unit according to the present embodiment.

FIGS. 1 to 3 depict views describing a paper feed unit of an inkjet printer according to the embodiment of the present invention. FIG. 1 depicts a perspective view showing an external appearance of an entire paper feed unit 1; FIG. 2 depicts a perspective view showing an external appearance of a paper feed cassette 3; and FIG. 3 depicts a perspective view showing an external appearance of a unit's main body 2 in which the paper feed cassette 3 and cover are removed from FIG. 1. The paper feed unit 1 is largely divided into the unit's main body 2 and the paper feed cassette 3.

Referring to FIG. 1, numeral 1 denotes the entire cassette paper feed unit. By mounting this paper feed unit 1 to an inkjet printer main unit which will be described later, paper (hereinafter referred to as a printing sheet) can be fed to the inkjet printer main unit and printing on the printing sheet can be performed. Numeral 13 denotes a right cosmetic panel covering the unit's main body 2; and numeral 14 denotes a left cosmetic panel covering the unit's main body 2. The panels 13 and 14 match the outer shape of the inkjet printer's main body which. Numeral 15 denotes a right cover for covering the top right portion of the unit's main body 2; and numeral 16 denotes a left cover for covering the top left portion of the unit's main body 2. Numeral 17 denotes a separation base which surrounds the mechanical components that will be described later and defines the positioning surface of the paper feed cassette 3. Numeral 18 denotes a metal-plate upper stay serving as a structure for maintaining the strength of the paper feed unit 1. Numerals 19 and 20 respectively denote a right hook and a left hook, provided on the right cover 15 and the left cover 16, for hooking and fixing the inkjet printer's main body. Numerals 21 and 22 respectively denote a right pin and a left pin, which are projected from the separation base 17, for positioning the left and right when the inkjet printer's main body is mounted. Numerals 23 and 24 respectively denote a right movable hook and a left movable hook, provided on the separation base 17, which are pressured at the position shown in the drawing by a spring (not shown). When the printer's main body is mounted on the paper feed unit, the movable hooks 23 and 24 turn to lock the printer's main body. When a back surface button (not shown) is depressed, the movable hooks 23 and 24 turn against the spring (not shown) to release the lock, and the inkjet printer's main body can be separated from the paper feed unit 1 by lifting up the inkjet printer's main body. Numeral 47 denotes a connector (female) provided on the separation base 17. When the printer's main body is mounted on the paper feed unit 1, the connector 47 engages with a male connector provided on the bottom surface of the printer's main body to bring the electricity into conduction, and electric signals from the printer and motor driving signals can be inputted.

FIG. 2 depicts a perspective view showing an overall view of the paper feed cassette 3.

In FIG. 2, numeral 4 denotes a cassette tray capable of holding B5-, A4-, and LTR-size printing sheets (not shown). A printing sheet is pushed to the reference-side wall 10 of the cassette tray 4, and the side guide 5 and end guide 6 are moved to push the printing sheet, thereby positioning the printing sheet. The side guide 5 and end guide 6 are fixed to the cassette tray 4 by a ratchet 7. Numeral 8 denotes a pressure plate which can be turned at the rotation center 11. On the pressure plate 8, a separation sheet 9 is attached by a double-faced tape. The separation sheet 9, which is made of cork, serves to apply friction binding force to a printing sheet set on the very bottom so as not to transfer a pile of overlapping printing sheets at the time of pickup of a paper. The paper feed cassette 3 having a stack of printing sheets is inserted to the paper feed cassette unit's main body 2 (FIG. 3) which will be described later.

FIG. 3 shows an external appearance of the unit's main body 2. For the purpose of explanation, the right cosmetic panel 13, left cosmetic panel 14, right cover 15 and left cover 16 are removed in the drawing.

In FIG. 3, numeral 25 denotes a metal base plate. The aforementioned right cover 15, left cover 16, and separation base 17 are fixed to the base plate 25 with screws. Numeral 26 denotes a cassette pressing pin which presses the paper feed cassette 3 to a reference surface (not shown) of the right cover 15 using a compression spring 27. By pressing the paper feed cassette 3 with the pressing pin 26, the paper feed cassette 3 is positioned in the lateral direction of the unit's main body 2. A concave (not shown) for housing the cassette pressing pin 26 is provided on the left side surface of the cassette tray 4. Therefore, positioning of the paper feed cassette 3 is also realized in the depth direction of the paper feed unit 1. Numeral 28 denotes an earth spring which comes in contact with a chassis portion of the printing apparatus, for grounding. The earth spring 28 is fixed to the left cover 16 which is omitted in FIG. 3. Numeral 29 denotes a pickup roller which is press-fitted into a part of a pickup roller guide 33. Numeral 32 denotes a feed roller where two rubber pieces are integrated to a metal shaft by baking. Numeral 38 denotes a pinch roller which is pressed against the rubber piece of the feed roller 32 by a spring shaft (not shown) with about 100 gf. Numeral 30 denotes a metal pressboard which moves up and down by coming into contact with the pressure plate 8 in FIG. 2. Numeral 48 denotes a right chassis which is screwed to the base plate 25. Numeral 49 denotes a left chassis which is similarly screwed to the base plate 25. Numeral 50 denotes a cassette motor (stepping motor) serving as a driving source, which applies rotation force to the pressure plate 8, pickup roller 29 and feed roller 32.

Described next is a brief construction of an inkjet printer main body mounted to the paper feed unit 1.

Figure 4:
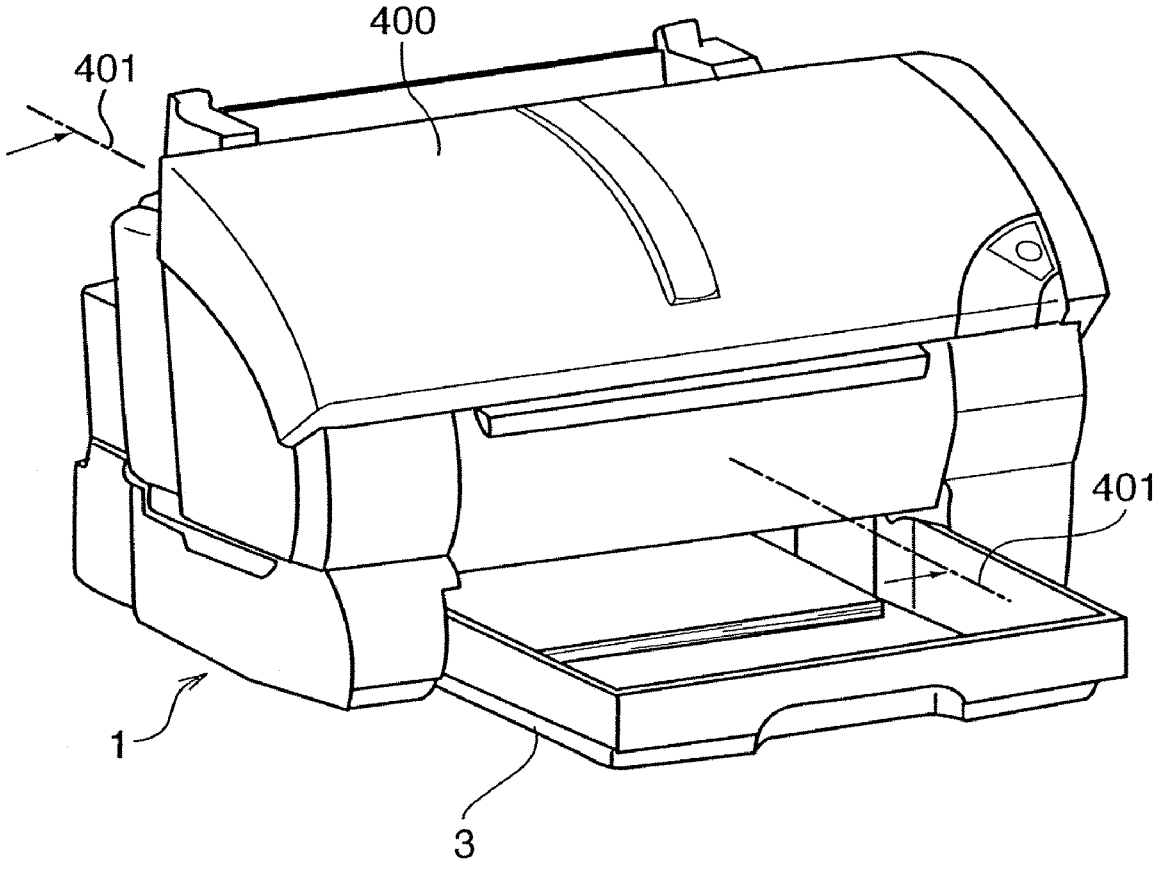
FIG. 4 depicts an external view of the inkjet printer which is mounted on the paper feed unit according to the present embodiment.

FIG. 4 depicts a perspective view showing an overall construction of the inkjet printer 400 which is mounted on the paper feed unit 1.

Figure 5:
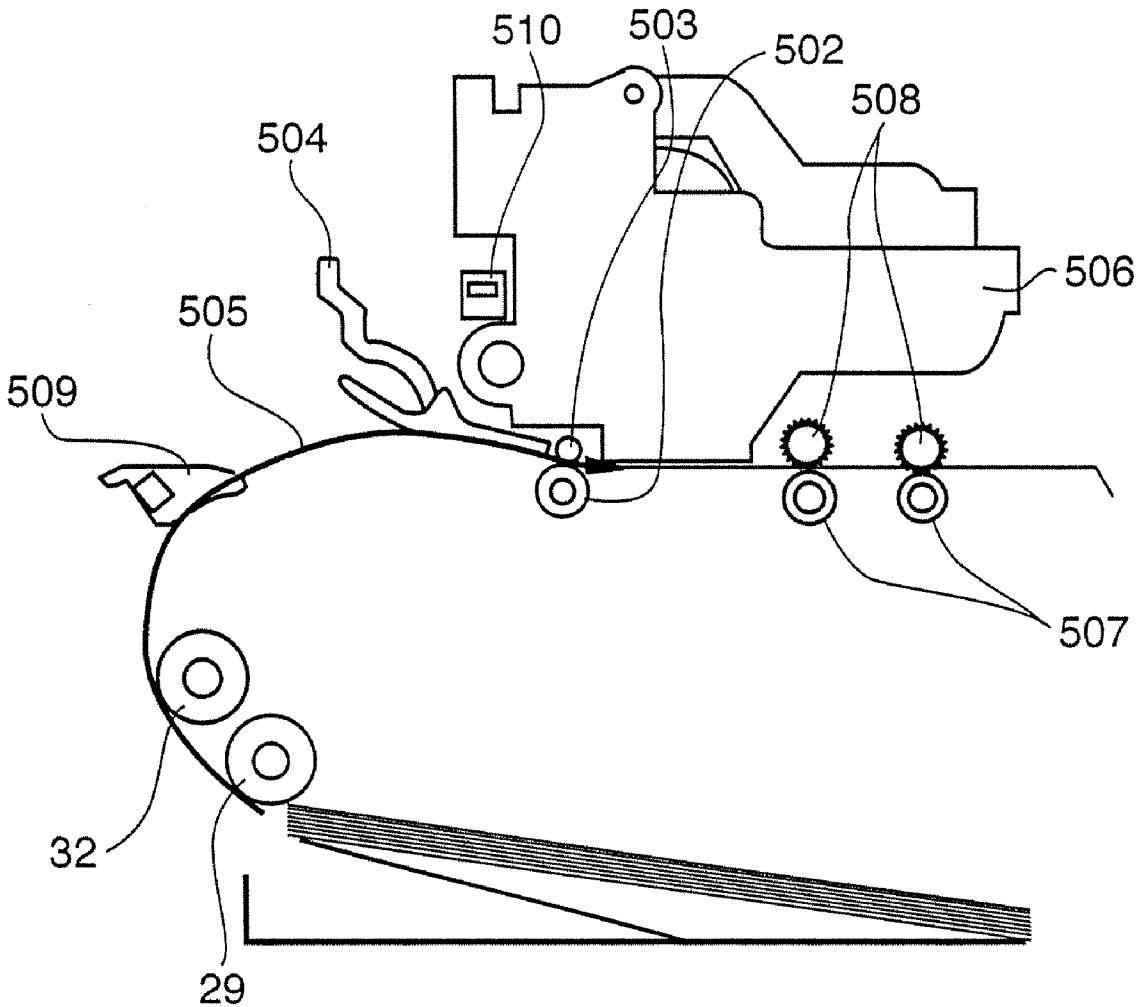
FIG. 5 depicts a cross section showing the construction of the inkjet printer cut across the section 401 in FIG. 4.

FIG. 5 depicts a cross section of the inkjet printer 400 mounted on the paper feed unit 1, which is cut across the section 401 in FIG. 4, and shows only the main components of the apparatus. Components that are common to the above-described drawings are referred to by the same reference numerals.

In FIG. 5, numeral 502 denotes a LF roller which intermittently transfers a fed printing sheet. A pinch roller 503 is pressed against the LF roller 502 with a predetermined load. There are plural pinch rollers 503 provided in the main-scanning direction (the direction perpendicular to FIG. 5) to accurately transfer a printing sheet during printing. A PE sensor lever 504 alternatively sways by contacting a printing sheet or being away from a printing sheet when the leading edge or trailing edge of a printing sheet passes. By detecting the sway of the top end of the lever 504 using a transmissive photodetector (PE sensor 510), a timing of arriving and passage of the printing sheet can be detected. Note FIG. 5 shows a state where a printing sheet is present (PE sensor 510 does not detect the lever 504). When a printing sheet is not present in the conveyance path, the lever 504 turns about 90 degrees clockwise in FIG. 5 to shield a light of the PE sensor 510 so that the PE sensor 504 detects the lever 504, and it is determined that there is no printing sheet.

Numeral 509 denotes a cassette PE sensor which detects passage of a printing sheet at the cassette PE sensor 509 using a transmissive photodetector (not shown). By virtue of the sensor 509, it is possible to detect a timing of a printing sheet passing through the cassette PE sensor 509, and presence/non-presence of a printing sheet. Note that the distance between the feed roller 32 and the sheet detection position by the PE sensor lever 504 is about 150 mm. As described above, a printing sheet picked up by the pickup roller 29 is separated from the stacked papers, and conveyed by clockwise rotation of the feed roller 32 through the conveyance path 505 of the inkjet printer 400.

The feed roller 32, the pick up roller 29 and a motor for driving the rollers and the like are called as a medium feeding means in the present application.

When printing is performed, the printing sheet is intermittently transferred while it is tightly held by the LF roller 502 and the pinch roller 503. Ink is discharged to the printing sheet from an inkjet head (not shown) mounted on a carriage 506 which scans in the main-scanning direction, and an image is printed on the printing sheet. The printing sheet on which printing is performed in the foregoing manner is tightly held by the discharge rollers 507 and spurs 508, and rotation of these members discharges the printed sheet outside the apparatus (right side of FIG. 5).

The LF roller 502, the pinch roller 503, the discharge rollers 507 and spurs 508 and motors for driving the rollers and the like are called as a medium conveying means in the present application.

Figure 6:
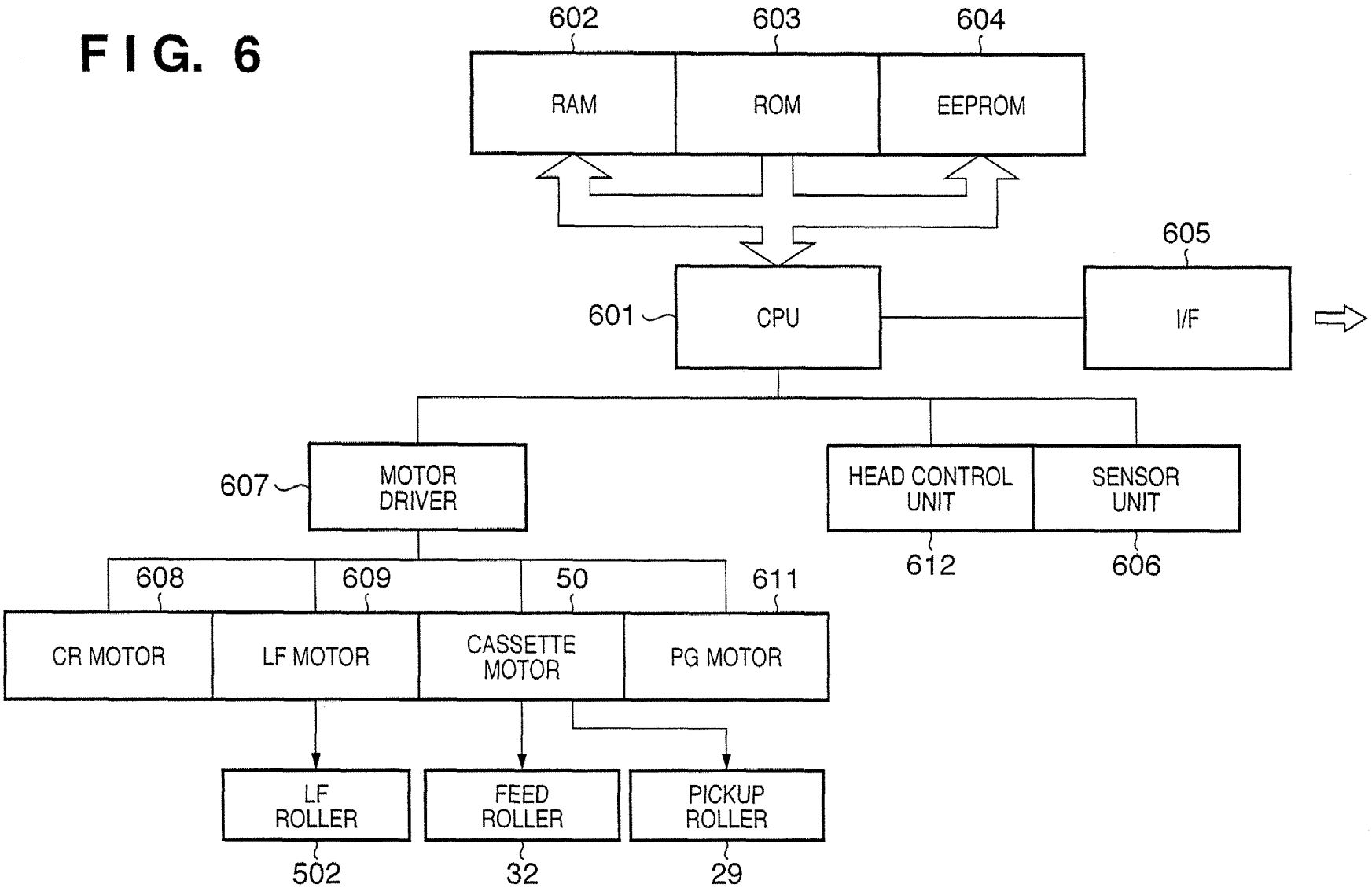
FIG. 6 is a block diagram showing a construction of the inkjet printer according to the present embodiment.

FIG. 6 is a block diagram showing a construction of the main components of the inkjet printer according to the present embodiment.

In FIG. 6, numeral 601 denotes a CPU serving as a main controller, which controls printing data generation, motor driving for printing process, printhead discharge control, analysis of a command transmitted from an external device such as a host computer, input control of data inputted from an operation panel (not shown) or outputted to an operation panel, and the like. RAM 602 provides a work area for temporarily storing various data at the time of program execution and a memory area for storing inputted image data or printing data. ROM 603 stores a program executed by the CPU 601 and various data. Among them, various data include data used as an initial value and data developed in the RAM 602 to be processed by the CPU 601. EEPROM 604 stores information about the inkjet printer. The information stored in the EEPROM 604 includes, not only the set state of the inkjet printer, but also the number of sheets printed, the remaining amount of ink, and so on. Information regarding the set state of the inkjet printer includes functions, such as an automatic power control switch, a drying mode, and so on.

Numeral 605 denotes an I/F (interface) for receiving image data from a host computer and outputting data to the host computer. The image data received from the host computer is read by the CPU 601 and developed in the RAM 602 as image data. The I/F 605 is capable of bi-directional communication with the host computer via the IEEE 1284, IEEE 1394, USB, or wirelessly. A sensor unit 606 is constructed with plural sensors for detecting an environmental temperature, a printhead temperature, presence/non-presence of a printing sheet (including the PE sensor 504, the cassette sensor 509 and the like) and so forth. A carriage (CR) motor 608 is driven to be rotated to move the printhead (inkjet head) in the main-scanning direction. A line feed (LF) motor 609 rotates the LF roller 502 (medium conveying means) to convey a printing sheet in the sub-scanning direction. The aforementioned cassette motor 50 rotates the pickup roller 29 (medium feeding means) to pick up the top printing sheet contained in the paper feed cassette 3. The feed roller 32 (medium feeding means) is also rotated by the cassette motor 50 to feed the sheet. A purge (PG) motor 611 is employed to perform the recovery operation of the printhead. A motor driver 607 is provided for driving the aforementioned four motors, respectively. Each motor is capable of independent rotation. A printhead controller 612 performs printhead discharge control using the printhead in accordance with a designation of the CPU 601.

Figure 7:
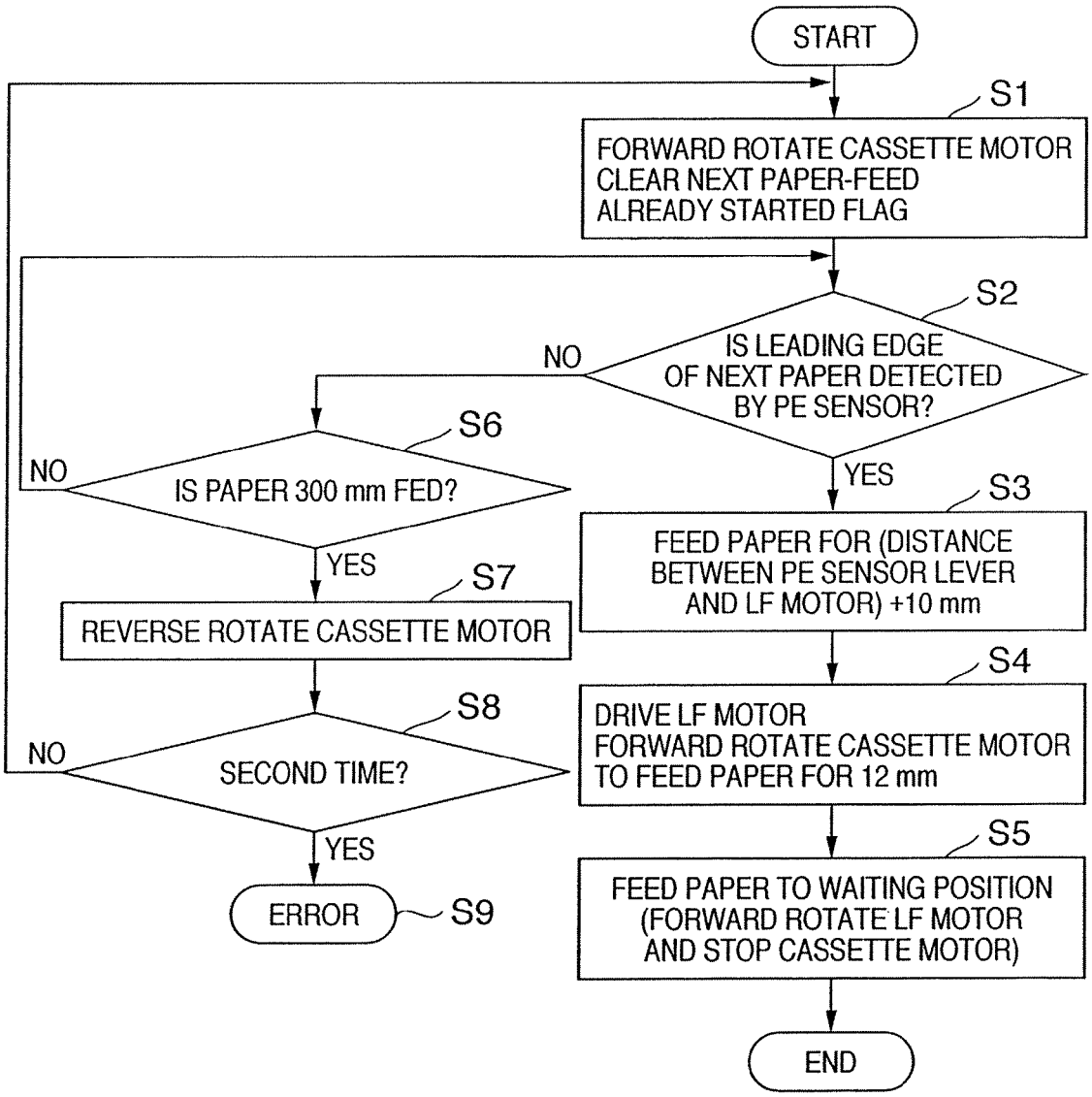
FIG. 7 is a flowchart for describing paper feed operation (pick and feed it to a position near of a recording position) in the inkjet printer according to the present embodiment.

FIG. 7 is a flowchart briefly describing paper feed operation (pickup and feed before a printing position by the medium feeding means) in the state (FIG. 4) where the inkjet printer 400 is mounted on the cassette paper feed unit 1. The processing is executed when paper feeding is necessary prior to the start of printing. Note that the program realizing this processing shown in the flowchart is stored in the ROM 603 and executed under the control of CPU 601.

First in step S1, the cassette motor 50 is rotated in a forward direction to pick up a top-most printing sheet contained in the paper feed cassette 3 and feed it. Note in this step, a "next paper-feed already started flag" (stored in the RAM 602), which is used at the time of next-page-presence processing and print termination processing (described later), is cleared. In step S2, it is determined whether or not the PE sensor 510 detects the leading edge of the printing sheet being fed in the step S1. When the leading edge of the printing sheet is detected in step S2, the control proceeds to step S3. In step S3, the feed roller 32 (cassette motor 50) is driven to feed the printing sheet for a distance of adding 10-mm to the distance between a sensing point of the PE sensor lever 504 and the LF roller 502. In this stage, since rotation of the LF roller 502 has not yet been started, the leading edge of the printing sheet being fed is pushed to the contact portion of the LF roller 502 and pinch roller 503, thereby forming a loop. By virtue of this, it is possible to keep the orientation of the leading edge of the printing sheet (parallel orientation with respect to the conveyance path 505), and prevent tilted printing caused by skewing of the printing sheet.

When the skewing of the printing sheet is straightened out, the control proceeds to step S4. The LF motor (DC motor) 609 is rotated in a forward direction to rotate the LF roller 502 (note that the rotation of the DC motor 609 is controlled based on a signal from an encoder attached to a main shaft of the DC motor 609). As a result, the printing sheet that has been pushed to the LF roller 502 is held by the LF roller 502 and pinch roller 503 and then conveyed as the LF roller 502 rotates. Upon conveying the sheet, the cassette motor 50 is also rotated in a forward direction to feed the printing sheet for 12 mm in synchronization with the rotation of the LF motor 609.

Then, the control proceeds to step S5. The rotation of the cassette motor 50 (rotation of the feed roller 32) is stopped, and the LF roller 502 is further rotated to convey the printing sheet to a waiting position (the leading edge of the printing sheet is located at a print ready position). Then, the rotation of the LF roller 502 is stopped. At the same time, the cassette motor 50 (feed roller 32 and pickup roller 29) is rotated in a reverse direction (rotate the feed roller 32 and pickup roller 29 in the counterclockwise direction). Then, a pressboard cam gear is rotated 40 degrees to return to the initial position, and stopped. In this state, the feed roller 32 is detached from the pinch roller 38. Therefore, while the LF roller 502 intermittently conveys the printing sheet during print operation, there is no tensile resistance (by the feed roller 32) in the upper stream of the printing sheet conveyance direction. Accordingly, it is possible to secure precision in printing sheet conveyance.

Meanwhile in step S2, if the PE sensor 510 does not detect the leading edge of the printing sheet, the control proceeds to step S6. In step S6, it is determined whether or not the cassette motor 50 (feed roller 32) has been driven to feed the printing sheet for 300 mm. If the cassette motor 50 is not driven to feed the printing sheet for 300 mm, the control returns to step S2 to further step-drive the feed roller 32 and determine whether or not the PE sensor 510 has detected the leading edge of the printing sheet.

In step S6, if the cassette motor 50 is driven to feed the printing sheet for 300 mm, the control proceeds to step S7. This indicates that driving the cassette motor 50 for a predetermined amount does not allow the leading edge of the printing sheet to reach the PE sensor lever 504. In this case, the cassette motor 50 is rotated in the reverse direction to return the printing sheet towards the pickup roller 29, and the control proceeds to step S8. In step S8, it is determined whether or not this is the second try. If NO, the control returns to step S1 to start the rotation of the cassette motor 50 in the forward direction again and the above described steps are implemented again.

If it is the second try in step S8, the control proceeds to step S9. In step S9, an indication of "error of no-printing-sheet" is displayed on the display unit of the operation unit in the inkjet printer 400. Note that the warning indication may be displayed as a message, or a lamp such as an LED or the like may be lit, or a buzzer or the like may be used.

Figure 8:
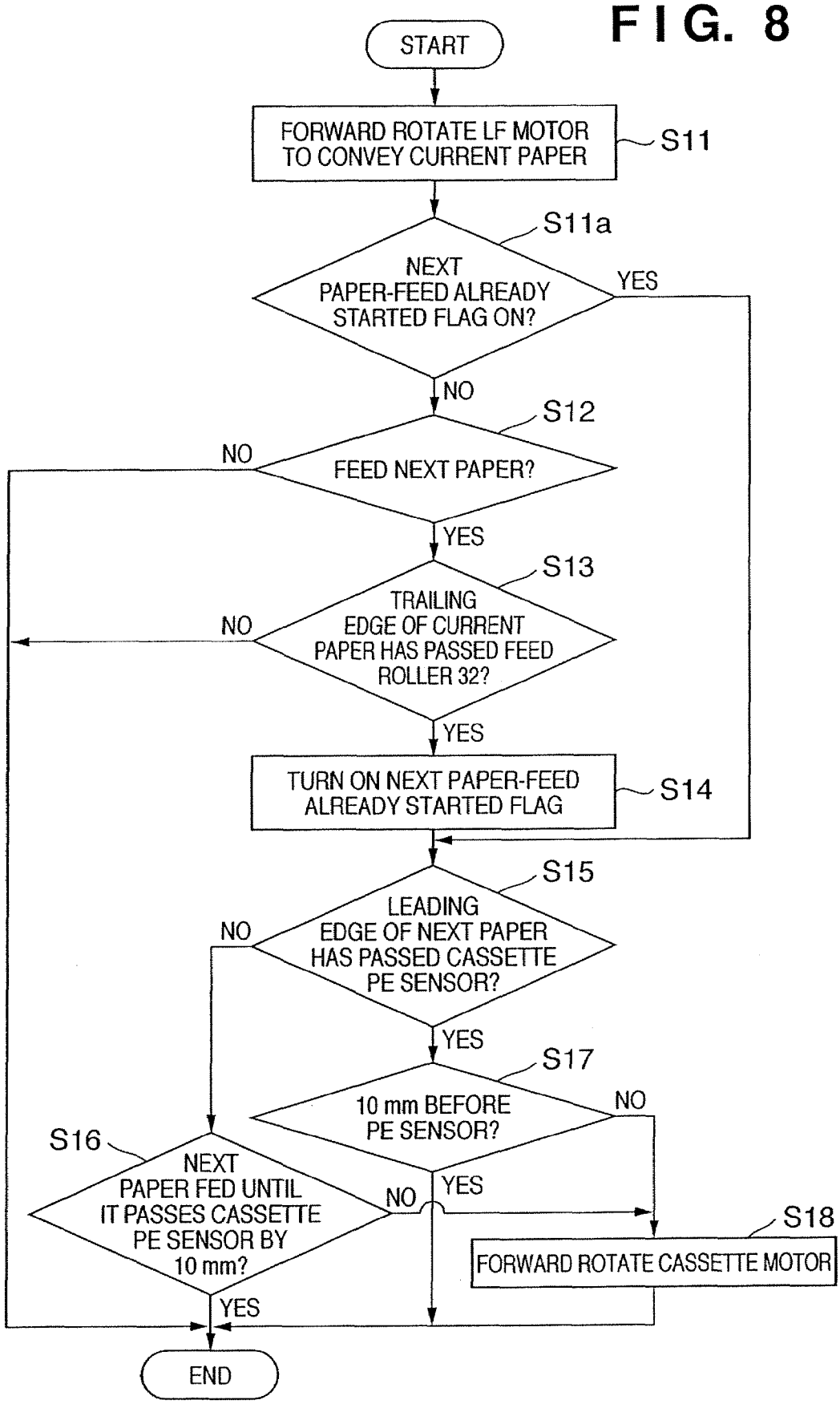
FIG. 8 is a flowchart for describing a case where a next printing sheet is conveyed during the feed operation of a current printing sheet being recorded in the inkjet printer according to the present embodiment.

In FIG. 8, a description is provided on processing performed in a case where it is determined that the printing to the next printing sheet is necessary (printing continues for the next printing sheet, i.e., a printing of the next printing sheet is performed following the printing of the current printing sheet, at the time of conveying the printing sheet being printed as the current printing sheet for a predetermined distance (predetermined step). The description is given with reference to the flowchart in FIG. 8 and the positional relation between the rollers and sensors as well as the printing sheet conveyed from the feed roller 32 to the LF roller 502 shown in FIG. 9.

FIG. 8 is a flowchart describing paper feed processing of a next printing sheet following the current printing sheet during conveyance of the current printing sheet, in a case where there is image data to be printed on the next printing sheet in the inkjet printer 400 which integrates the cassette paper feed unit 1 (as shown in FIG. 4) according to the present invention. This processing is performed when the rotation of the LF roller 502 is started for the printing of the current printing sheet. Note that the program realizing this processing shown in the flowchart is stored in the ROM 603.

In step S11, the LF motor 609 is rotated in the forward direction to rotate the LF roller 502 in the forward direction and perform predetermined step conveyance (convey the printing sheet for a distance corresponding to a printing width already printed on the current printing sheet) of the current printing sheet which is currently subjected to printing operation.

In step S11*a*, the "next paper-feed already started flag" is checked. In a case where the "next paper-feed already started flag" is ON, steps S12, S13 and S14 are skipped and the control proceeds to step S15.

If the "next paper-feed already started flag" is OFF in step S11*a*, the control proceeds to step S12, it is determined whether or not to feed the next printing sheet for a next page. If the next printing sheet is to be fed, the control proceeds to step S13, whereas if the next printing sheet is not to be fed, the control ends without performing feeding of the next printing sheet. In determination of whether or not to feed the next printing sheet, for instance, in a case where the inkjet printer is set in a power-consumption (power-saving) mode, the feeding of the next printing sheet is not performed. In the mode where the printing speed is prioritized than image quality (printing speed priority mode), the feeding of the next printing sheet is performed. Besides these, it is determined whether or not to start the next printing sheet, based on whether or not the printing apparatus is set in a quiet mode, whether or not the apparatus is set in a printing mode that requires the feeding of the next printing sheet, or the like.

In step S13, it is determined whether or not the trailing edge of the current printing sheet has passed the feed roller 32. If YES, the control proceeds to step S14. If NO, the control ends without performing the feeding of the next printing sheet.

This processing prevents so-called overlapping conveyance in which the current printing sheet and the next printing sheet are conveyed on top of each other. The overlapping conveyance occurs if the feeding of the next printing sheet is started when the trailing edge of the current printing sheet has not yet passed through the feed roller 32 (the trailing edge of the current printing sheet is in contact with the feed roller 32). Furthermore, this processing also has an effect of allowing a predetermined or more space between the trailing edge of the current printing sheet and the leading edge of the next printing sheet.

In step S13, it is determined in the following manner whether or not the trailing edge of the current printing sheet has passed through the feed roller 32. More specifically, the trailing edge of the current printing sheet (CurrentPaperEndPosition) from the PE sensor lever 504 is obtained based on the conveyance distance (CurrentPaperNow) of the leading edge of the current printing sheet from the PE sensor lever 504 and the length of the current printing sheet (CurrentPaperLength).

(CurrentPaperEndPosition)=(CurrentPaperLength)−(CurrentPaperNow)=(sheet length of the current printing sheet)−(conveyance distance of the leading edge of the current printing sheet from the PE sensor lever 504)

When the trailing edge of the current printing sheet (CurrentPaperEndPosition) from the PE sensor lever 504 is smaller than 150 mm, it is determined that the trailing edge of the current printing sheet has passed through the feed roller 32. For this determination, for instance, a counter (total pulse counter) for counting the total driving amount (pulse number) of the cassette motor 50 is provided in the RAM 602 in FIG. 6. It is determined based on the value of this counter whether or not the trailing edge of the current printing sheet has passed the feed roller 32. The counter value is updated each time the cassette motor 50 is driven.

In step S14, the "next paper-feed already started flag" in the RAM 602 is turned ON, and preparation is made to perform printing termination processing which will be described later. In step S15, it is determined whether or not the leading edge of the next printing sheet has passed through the PE sensor lever 504 (whether or not the PE sensor 504 is ON). If YES (a the next printing sheet is present), the control proceeds to step S17. If NO (the next printing sheet is not present), the control proceeds to step S16.

Since the processing described in the flowchart in FIG. 8 is started each time the current printing sheet being printed is conveyed, it is determined in step S16 based on the total pulse counter value, whether or not the leading edge of the next printing sheet is fed until the position 900 (FIG. 9A), which is 10 mm downstream the sensing position of the cassette PE sensor 509 in the conveyance direction.

Figures 9A, 9B, 9C, 9D:
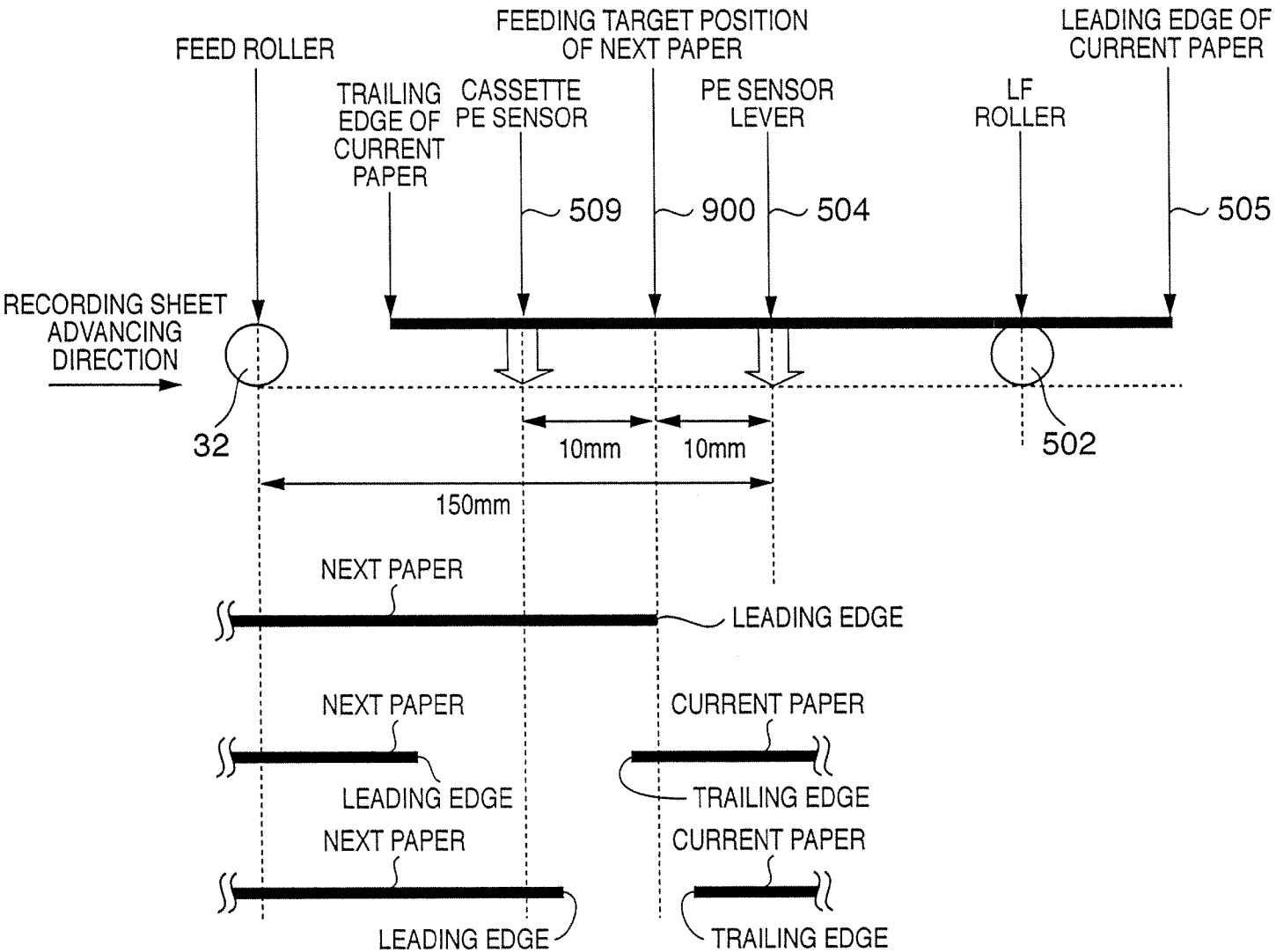
FIG. 9A to 9D depict an explanatory view describing a positional relation between the rollers and sensors in the printing sheet conveyance path and a positional relation between the current printing sheet and the next printing sheet in the inkjet printer according to the present embodiment.

If the next printing sheet has been fed to the position 900 as shown in FIG. 9B, the control ends. However, if the next printing sheet has not been fed to the position 900 as shown in FIG. 9C or 9D, the control proceeds to step S18 where the cassette motor 50 is step-driven.

The feeding of a printing sheet from the cassette 3 to the position 900 is realized by driving the cassette motor 50 once, or driving the cassette motor 50 a few number of times, for example, twice or three times. This is due to the fact that the amount of driving (the amount of rotation) of the cassette motor 50 when it is driven once (feeding distance of the feed roller 32) is not predetermined, but changes depending on the feeding distance by the rotation of the feed roller 32.

In other words, the feeding of the next printing sheet depends on the printing operation on the current printing sheet, i.e., it corresponds to the progress of the conveyance of the current printing sheet executed by the medium conveying means, after the printhead is scanned for printing one band of image. In a case where the amount of conveyance of the current printing sheet by the medium conveying means is large, the feeding distance of the next printing sheet by the medium feeding means also becomes large, on the other hand, in a case where the amount of conveyance the current printing sheet by the medium conveying means is small, the feeding distance of the next printing sheet by the medium feeding means becomes small. The conveyance distance of the current printing sheet by the medium conveying means depends on image data printed on the current printing sheet, or a printing mode (1-pass printing or multi-pass printing).

Meanwhile, if it is determined in step S16 that the leading edge of the next printing sheet is conveyed until the leading edge has passed the sensing position of the cassette PE sensor 509 by 10 mm, it is considered that the leading edge of the next printing sheet has reached the target position 900 of the next printing sheet shown in FIG. 9B, and the control ends without rotating the cassette motor 50 in the forward direction.

In step S15, if it is determined that the leading edge of the next printing sheet fed by the medium feeding means has passed through the cassette PE sensor 509, the control proceeds to step S17. In step S17, it is determined based on the total pulse counter value whether or not the fed position of the next printing sheet is 10 mm before the PE sensor lever 504 (900 in FIG. 9A: the target position of the next printing sheet). If the leading edge of the next printing sheet has not reached the position 900, the control proceeds to step S18 where the cassette motor 50 is step-driven in the forward direction. In this case, the feeding amount of the next printing sheet corresponds to the conveyance distance of the current printing sheet.

If YES in step S17, it means that the leading edge of the next printing sheet has reached the target position 900 of the next printing sheet, which is 10 mm before (upstream in the conveyance direction) the PE sensor lever 504 in FIG. 9B.

Note, in a case where the next printing sheet is fed for a distance corresponding to the conveyance distance of the current printing sheet based on the total pulse counter value, a control step may be added for determining whether or not the leading edge of the next printing sheet has passed the position 900 (whether or not the leading edge of the next printing sheet has been fed through the position 900), so as to satisfy the amount of feeding of the next printing sheet<the amount of conveyance of the current printing sheet, i.e., (feeding amount by the feed roller 32)<(conveyance amount of LF roller 502).

The rotation amount of the cassette motor 50 driven in step S19 is a value obtained by multiplying the stepping number that caused the forward rotation of the LF motor 609 in step S11 by a gear ratio of the system which transmits motor's rotation to the roller. The gear ratio will be described later. Since the construction of the present embodiment is purposed to allow a predetermined or more space between the trailing edge of the current printing sheet and the leading edge of the next printing sheet, it is necessary to match the conveyance distance of the current printing sheet with the feeding distance of the next printing sheet. Note that the maximum rotation amount of the cassette motor 50 driven in step S19 is an amount corresponding to the distance to the target position 900.

Note that the aforementioned target position 900 of the leading edge of the next printing sheet is a waiting position for starting the feeding processing described in steps S3 and S4 in FIG. 7. By virtue of stopping the leading edge of the next printing sheet at this position 900, it is possible to maintain a distance between the trailing edge of the current printing sheet and the leading edge of the next printing sheet and prevent overlapping trailing edge of the current printing sheet and the leading edge of the next printing sheet. Note that the distance between the target position 900 and the PE sensor lever 504 is determined base on the amount of motion of the PE sensor lever 504 as well as a difference between the printing-sheet feeding timing of the feed roller 32 and the printing-sheet conveyance timing of the LF roller 502; therefore, it is not limited to 10 mm.

After the leading edge of the next printing sheet reaches the target position 900, the conveyance of the next printing sheet by the LF roller 502 is started, e.g., at the timing the image data processing is completed and data transmission to the printhead is ready, and then the next printing sheet is conveyed to the printing position by the printhead by the conveying means.

Furthermore, in the present embodiment, the LF roller 502 and the feed roller 32 are driven by different motors. Since the conveyance distance of the printing sheet corresponding to each motor driving amount is different for each motor, a gear ratio that achieves approximately 1:1 conveyance distance is obtained. Based on the obtained gear ratio and the driving amount of the LF motor 502, the amount of forward rotation of the cassette motor 50 is obtained.

Figure 10:
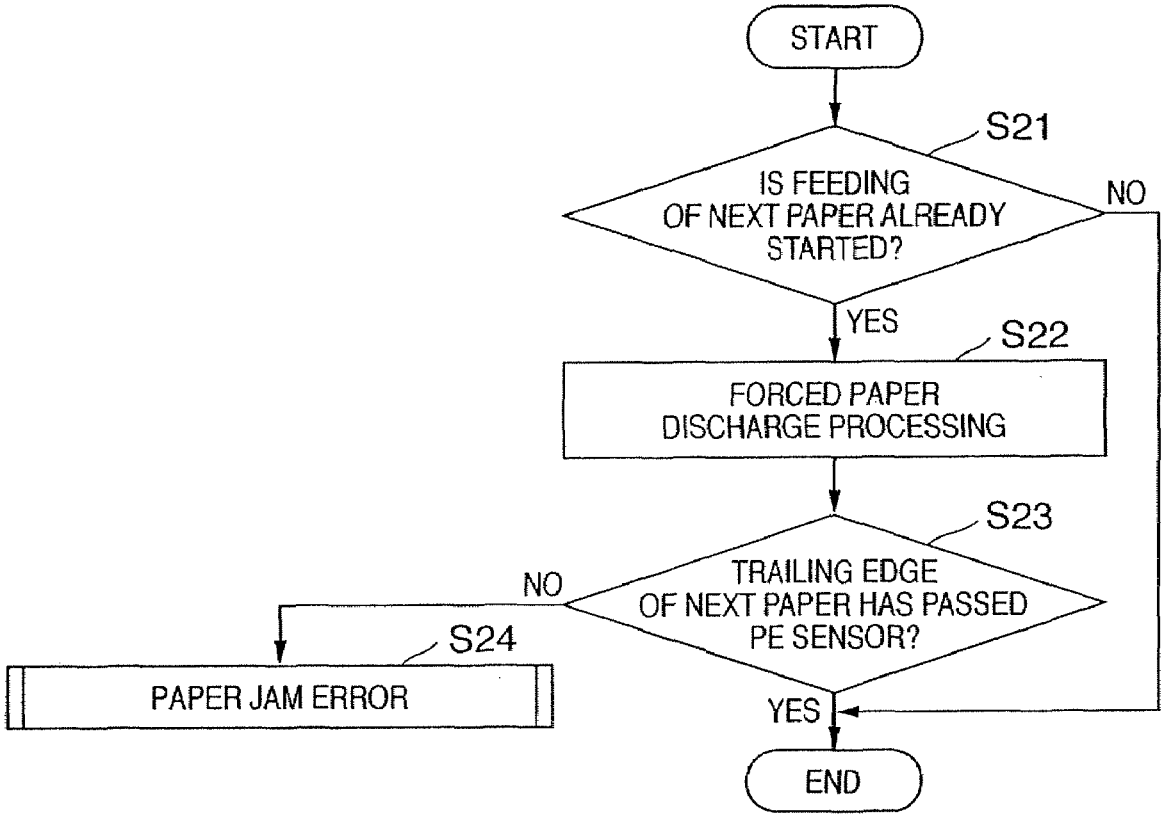
FIG. 10 is a flowchart for describing paper discharge processing at the time of print termination in the inkjet printer according to the present embodiment.

FIG. 10 is a flowchart describing a process in a case of printing termination during printing of a current printing sheet or after printing of a current printing sheet is completed. This processing is particularly effective in a case where it is determined that image data for the next printing sheet exists during printing of the current printing sheet, but the termination of the printing is designated by a user during feeding of the next printing sheet.

In step S21, it is determined whether or not the "next paper-feed already started flag" set in step S14 in FIG. 8 is ON. If the feeding of the next printing sheet has already been started, the control proceeds to step S22 to execute forced paper discharge processing. In this case, the LF roller 502 and the feed roller 32 are driven to discharge the printed sheet (the current printing sheet) outside the printing apparatus. In the construction of the printing apparatus according to the present embodiment whose function has been reduced for the purpose of low cost, once the feeding of the next printing sheet is started, it is impossible to put the already-fed next printing sheet back.

In step S23, it is determined whether or not the trailing edge of the next printing sheet has passed the PE sensor lever 504. If it has passed the PE sensor lever 504, the control ends normally. If it has not passed the PE sensor lever 504, the control proceeds to step S24 where an indication of paper jam error is displayed on the display unit of the inkjet printer 400.

Note that the present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium (or a recording medium) storing program codes of a software for realizing the functions of the above embodiment to a computer system or apparatus, reading the program codes, by a computer (CPU or MPU) of the computer system or apparatus, from the storage medium, then executing the program. In this case, the program codes read from the storage medium realize the functions according to the embodiment, and the storage medium storing the program codes constitutes the invention. Furthermore, besides aforesaid functions according to the above embodiment are realized by executing the program codes which are read by a computer, the present invention includes a case where an OS (operating system) or the like working on the computer performs a part or the entire processes in accordance with designations of the program codes and realizes functions according to the above embodiment.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part or the entire processes in accordance with designations of the program codes and realizes functions of the above embodiment.

The present invention is not limited to the above embodiment and various changes and modifications can be made within the spirit and scope of the present invention. Therefore, to apprise the public of the scope of the present invention, the following claims are made.

What is claimed is:

1. A recording apparatus for recording by relatively moving a recording head with respect to a recording medium, comprising:

medium conveying means having a LF roller, for conveying a recording medium in a conveyance path including a recording position where recording is performed by the recording head;

medium feeding means for picking up a recording medium from a housing unit housing a plurality of recording media and conveying the picked-upped recording medium in the conveyance path to a position that said medium conveying means can convey the recording medium;

determining means for determining whether or not image recording for a next recording medium is necessary during recording of a current recording medium being recorded at the time; and control means for, in a case where it is determined by said determining means that the image recording for the next recording medium is necessary, controlling said medium feeding means to feed the next recording medium for a distance in the conveyance path, corresponding to a conveyance distance of the current recording medium by said medium conveying means, in synchronization with the conveyance of the current recording medium by said medium conveying means, until the next recording medium has been conveyed to a predetermined position at the upper stream side of the LF roller, wherein the conveyance distance corresponds to an amount of conveyance of the current recording medium conveyed by said medium conveyance means after the recording head is scanned for the recording.

2. The apparatus according to claim 1, further comprising:

first detecting means for detecting a leading edge of the recording medium on a downstream side of a conveyance direction by said medium feeding means; and obtaining means for obtaining a conveyance distance of the recording medium conveyed by said medium feeding means, wherein upon detection of the leading edge by said first detecting means, said medium feeding means is controlled to convey the next recording medium to a predetermined position before the recording position in the conveyance path, based on the conveyance distance obtained by said obtaining means.

3. The apparatus according to claim 1, wherein said medium feeding means includes:

a pickup roller configured to picking up a recording medium from the housing unit housing a plurality of recording media; and a feed roller configured to convey the recording medium picked-up by said pickup roller to a position of the LF roller.

4. The apparatus according to claim 1, wherein each of said medium conveying means and said medium feeding means includes a motor and a roller, and said control means controls said medium feeding means to feed the next recording medium for the distance corresponding to the conveyance distance by said medium conveying means based on a ratio of a gear which transmits the rotation of each motor to each roller in said medium conveying means and said medium feeding means.

5. The apparatus according to claim 4, further comprising second detecting means, provided between the predetermined position and the recording position, for detecting a leading edge of the recording medium, wherein based on detection of said second detecting means, said medium feeding means is controlled to push the leading edge of the next recording medium to the roller of said medium conveying means.

6. The apparatus according to claim 4, wherein the motor is a stepping motor, and said control means performs feeding of the recording medium by the number of activated steps of the stepping motor.

7. A recording medium conveyance control method of a recording apparatus for recording by relatively moving a recording head with respect to a recording medium, comprising:

a medium conveying step of conveying a recording medium through in a conveyance path including a recording position by rotating a LF roller during recording;

a medium feeding step of picking up a recording medium from a housing unit housing a plurality of recording media and conveying the picked-upped recording medium in the conveyance path to a position that the LF roller can convey the recording medium; and a control step of, in a case where it is determined that recording for a next recording medium is necessary during recording of a current recording medium being recorded, controlling feeding of the next recording medium in said medium feeding step to feed for a distance in the conveyance path, corresponding to a conveyance distance of the current recording medium by the LF roller, in synchronization with the conveyance of the current recording medium by the LF roller in said medium conveying step, until the next recording medium has been conveyed to a predetermined position at the upper stream side of the LF roller, wherein the conveyance distance corresponds to an amount of conveyance of the current recording medium conveyed in said medium conveyance step after the recording head is scanned for the recording.

* * * * *